United States Patent [19]

Gascho

[11] Patent Number: 4,787,185

[45] Date of Patent: Nov. 29, 1988

[54] LOG STRUCTURES AND METHOD OF CONSTRUCTING SAME

[76] Inventor: Dwayne Gascho, 1051 Schmid Rd., Fairview, Mich. 48621

[21] Appl. No.: 347,706

[22] Filed: Feb. 11, 1982

[51] Int. Cl.[4] ..... E04B 1/10

[52] U.S. Cl. ..... 52/233; 52/747; 52/593; 52/605; 405/284

[58] Field of Search ..... 52/233, 593, 605, 606, 52/285, 286, 567, 568, 569, 566, 571, 221; 405/31, 273, 284, 286

[56] References Cited

U.S. PATENT DOCUMENTS

| | | | |
|---|---|---|---|
| 183,042 | 10/1876 | Cummings | 52/589 |
| 263,914 | 9/1882 | Kern | 52/605 |
| 979,913 | 12/1910 | Ault | 52/286 |
| 1,552,077 | 9/1925 | Palanti | 52/286 |
| 2,123,016 | 7/1938 | McDaniel | 405/273 |
| 2,462,289 | 9/1949 | Rochon | 52/605 |
| 3,189,950 | 6/1965 | Johnson | 52/233 |
| 3,521,417 | 7/1970 | Onjukka | 52/233 |
| 3,962,842 | 6/1976 | Wilhelm | 52/256 |
| 4,034,527 | 7/1977 | Jalasjaa | 52/233 |
| 4,047,350 | 9/1977 | Chisum | 52/233 |
| 4,126,977 | 11/1978 | Chisum | 52/233 |

FOREIGN PATENT DOCUMENTS

| | | | |
|---|---|---|---|
| 0063802 | 3/1914 | Austria | 52/566 |
| 0167177 | 3/1950 | Austria | 52/233 |
| 0645222 | 7/1962 | Canada | 52/233 |
| 80923 | 5/1963 | France | 52/590 |
| 1373787 | 8/1964 | France | 52/233 |
| 0044909 | 10/1917 | Sweden | 52/233 |
| 0374816 | 3/1964 | Switzerland | 52/233 |
| 0005502 | of 1906 | United Kingdom | 52/233 |
| 0267772 | 3/1927 | United Kingdom | 52/593 |
| 1338575 | 11/1973 | United Kingdom | 52/233 |

*Primary Examiner*—Carl D. Friedman
*Attorney, Agent, or Firm*—Learman & McCulloch

[57] ABSTRACT

This invention relates to a unique log structure system and method of constructing same. An array of ripples is machined into parallel top and bottom surfaces of each log. The ripples are the same size, spacing and configuration and comprise peaks and valleys in the top ripple surface aligned with valleys and peaks, respectively, in the lower ripple surface. Logs are stacked with the top ripple surface of a lower log interlocked with a bottom ripple surface of an upper log. At the corners first and second logs are notched so as to interlock with their axes intersecting at a predetermined angle. Third and fourth logs are notched and interlocked at the structure corner with their axes also intersecting at the predetermined angle. The third and fourth logs are stacked on top of the first and second logs so their respective ripple surfaces interlock. Some logs are interlocked between other logs but with a narrower horizontal dimension so as to permit spaces between logs for wiring. Holes filled with sealant and additional notches aligning with the holes are formed in the logs perpendicular to the ripple surfaces where the logs are notched to prevent air passage through the notches. Additional ripple surfaces are provided on vertical surfaces of logs to facilitate butt and corner joining, particularly in logs of man-made materials.

The method includes the steps of forming upper and lower ripple surfaces in logs, stacking the logs, notching the logs, interlocking the notches, interlocking the ripple surfaces, forming holes through the logs at the interlocked notches, and filling the holes with sealant to prevent air flow through the notches.

8 Claims, 3 Drawing Sheets

LOG STRUCTURES AND METHOD OF CONSTRUCTING SAME

BACKGROUND OF THE INVENTION

The subject invention relates to unique log structures and the method of constructing same.

Log structures have been in common use for a great many years. Logs made of trees are irregular, leaving large gaps between logs which must be filled with caulk of some type. Modern machinery operations have enabled manufacturers to machine logs to uniform size and configurations, thereby reducing gap size between logs but still requiring caulking to provide a weather-tight seal between logs. Among such modern machined logs are those described in French Patent No. 1,373,787 and those described in the following U.S. Pat. Nos.: Ward, 1,942,348; Chisum 3,951,187; and Chisum 4,047,350, and Straight 3,473,277.

However, each of these prior art log structures suffer from one or more of the following disadvantages: caulking is still required between logs; different knives are required to form the upper and lower surfaces; water seepage between logs is not effectively prevented; interlocking log design employs sharp or angular configurations which easily break and prevent log alignment; at the corner of structures water and bees and other insects can enter cracks.

SUMMARY OF THE INVENTION

This invention relates to a unique log structure system and method of constructing same. An array of ripples is machined into parallel top and bottom surfaces of each log. The ripples are the same size, spacing and configuration and comprise peaks and valleys in the top ripple surface aligned with valleys and peaks, respectively, in the lower ripple surface. Logs are stacked with the top ripple surface of a lower log interlocked with a bottom ripple surface of an upper log. At the corners first and second logs are notched so as to interlock with their axes intersecting at a predetermined angle. Third and fourth logs are notched and interlocked at the structure corner with their axes also intersecting at the predetermined angle. The third and fourth logs are stacked on top of the first and second logs so their respective ripple surfaces interlock. Some logs are interlocked between other logs but with a narrower horizontal dimension so as to permit spaces between logs for wiring. Holes filled with sealant and additional notches aligning with the holes are formed in the logs perpendicular to the ripple surfaces where the logs are notched to prevent air passage through the notches. Additional ripple surfaces are provided on vertical surfaces of logs to facilitate butt and corner joining, particularly in logs of man-made materials.

The method includes the steps of forming upper and lower ripple surfaces in logs, stacking the logs, notching the logs, interlocking the notches, interlocking the ripple surfaces, forming holes through the logs at the interlocked notches, and filling the holes with sealant to prevent air flow through the notches.

It is a primary object of this invention to provide a log structure and method of constructing same in which no caulk or sealant is required and may be rapidly constructed.

It is a further object of this invention to provide a log structure and method of constructing same in which knives of a single configuration are utilized to form interlocking ripple surfaces on top and bottom log surfaces.

It is a further object of this invention to provide a log structure and method of constructing same in which an upper log exterior surface overlaps a lower log exterior surface to facilitate water runoff and prevent water intrusion.

It is a further object of this invention to provide an interlocked log structure which avoids the breaking of interlocking members and which permits self-alignment of even warped logs.

It is a further object of this invention to provide a log structure in which members are so tightly fitted that no water or bees can get in cracks between logs or at structure corners.

It is a further object of this invention to provide an interlocked log structure through which water does not seep and which may be utilized in breakwater and below grade building construction.

BRIEF DESCRIPTION OF THE DRAWINGS

The foregoing and other objects and advantages of this invention will be evidenced from the following description and the accompanying drawings, in which.

DESCRIPTION OF THE PREFERRED EMBODIMENTS

Before explaining the present invention in detail, it is to be understood that the invention is not limited in its application to the details of construction and arrangement of parts illustrated in the accompanying drawings as the subject invention may be practiced in other embodiments. It is further to be understood that the terminology employed in this description is employed to teach persons skilled in the art and is not intended to be limiting as to the embodiments in which the invention may be practiced.

Figure 1:
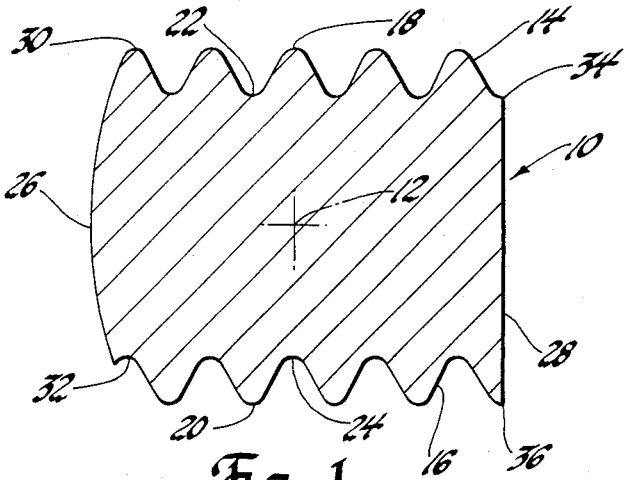
FIG. 1 is a cross-section of a log embodying the principles of the subject invention.

As shown in FIG. 1, a log 10 is illustrated in cross-section embodying the principles of the subject invention. While logs used in structures are commonly made of wood timbers, persons versed in the art will appreciate that plastic, concrete and other man-made materials may be employed to practice the subject invention. The log 10 may be defined as an elongated member having a longitudinal axis 12. Top and bottom ripple surfaces 14 and 16 are formed in the log 10 for purposes which will become apparent. Each of the ripple surfaces 14 and 16 contain an array of peaks and valleys. For purposes of description, a peak is defined to be a point on the top ripple surface 14 or bottom ripple surface 16 which is farthest away from the center of the log 10. A valley is defined to be a point on the top ripple surface 14 or the bottom ripple surface 16 which is nearest the center of the log 10. For example, peaks 18 and 20 are identified in FIG. 1 in the top and bottom ripple surfaces 14 and 16 while valleys 22 and 24 are identified in the top and bottom ripple surfaces 14 and 16, respectively.

The peaks and valleys in the top ripple surface 14 are of the same size, spacing and configuration as the peaks and valleys in the bottom ripple surface 16. In the preferred embodiments illustrated herein, the peaks and valleys of the top ripple surface 14 are aligned with the valleys and peaks, respectively, of the bottom ripple surface 16. For example, peak 18 is directly above valley 24 and valley 22 is directly above peak 20.

The top ripple surface 14 may be defined by a plane which is parallel to the longitudinal axis 12. Such a plane is positioned midway between the peaks and valleys of top ripple surface 14. Bottom ripple surface 16 is similarly defined by a plane parallel to the longitudinal axis 12 which is positioned midway between the peaks and valleys of bottom ripple surface 16. The planes which define the top and bottom ripple surfaces 14 and 16 are parallel and in the preferred embodiment are horizontal, although persons versed in the art could practice the subject invention by having the planes parallel but not horizontal. In the preferred embodiment the log 10 also has first and second side walls 26 and 28 which when the log 10 is used in a structure will be exterior and interior surfaces, respectively. For reasons which will become apparent, the exterior side wall 26 intersects the top ripple surface 14 proximate peak 30 and intersects bottom ripple surface 16 proximate valley 32. Similarly the interior side wall 28 intersects top ripple surface at a valley 34 and intersects bottom ripple surface 16 at a peak 36. The interior side wall 28 in the preferred embodiment is defined by a plane which is perpendicular to the planes which describe the top and bottom ripple surfaces 14 and 16 and is substantially parallel with a plane describing the exterior side wall 26 with the side walls being on opposite sides of the longitudinal axis 12.

Figure 2:
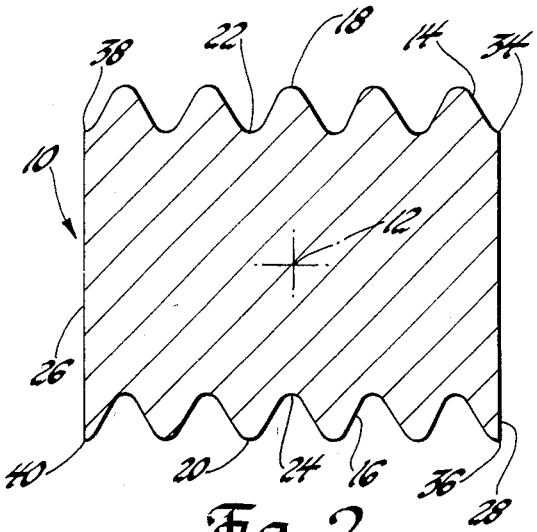
FIG. 2 is a cross-section of an alternative embodiment of the log in FIG. 1.

Persons versed in the art will appreciate that many people enjoy the aesthetic appearance of a log cabin having a rounded exterior surface 26. However, to fully utilize this invention it is preferred that the exterior side wall 26 be flat and parallel to side wall 28 and perpendicular to the planes which describe the top and bottom ripple surfaces 14 and 16 as illustrated in FIG. 2. It should be noted in FIG. 2 that the exterior wall 26 intersects the top ripple surface 14 at a valley 38 and intersects the bottom ripple 16 at a peak 40.

Figure 3:
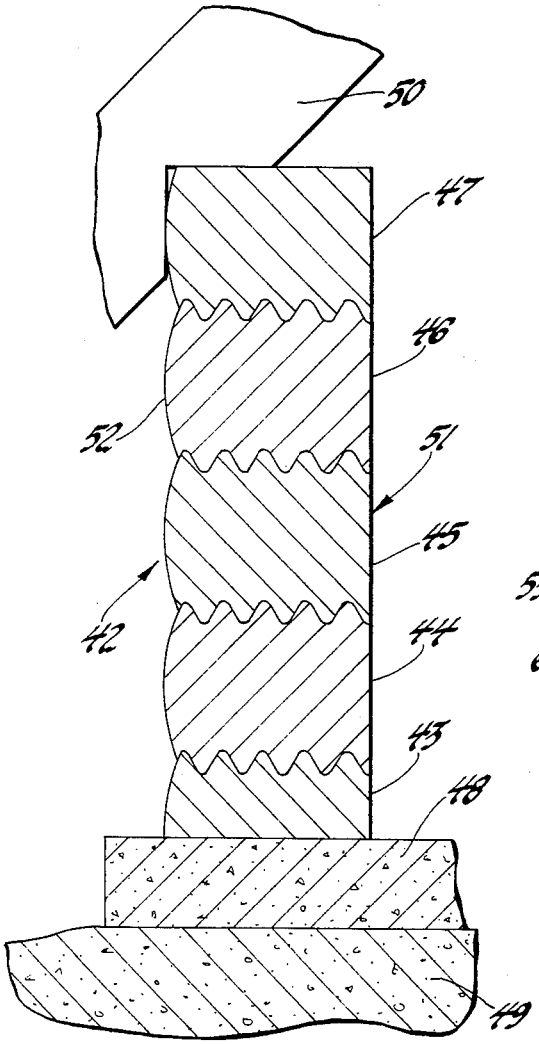
FIG. 3 is a cross-section of a log wall structure embodying the principles of this invention.

In FIG. 3 a log structure generally illustrated at 42 is shown in cross-section comprising a series of logs 43–47 which each have the cross-section of the log 10 except for the log 43 which has been cut lengthwise to provide a flat bottom surface that sits on a concrete slab 48 that in turn rests on the ground 49. A rafter 50 is partially illustrated simply to show an object supported by the log structure 42, though persons versed in the art will appreciate that many other objects and rafter configurations may be supported by the log structure 42 in place of the rafter 50. Upon examination of the log structure 42, it is apparent that a very tight fit is formed between each of the logs 43–47. In FIG. 3, the interior side walls of each of the logs 43–47 abut to form a smooth interior wall 51 with the interior wall of each of the logs 43–47 in perfect alignment in a single plane.

The exterior wall 52 of the log structure 42 is not flat because the exterior surface of the logs 43–47 are slightly curved to give the aesthetically pleasing appearance of a log cabin. However, the exterior wall 52 is watertight because at each junction between the logs 43–47 the exterior surface of the log on top of the junction overlaps the exterior surface of the log below the junction, each of the logs 43–47 having a cross-section like log 10 in FIG. 1, in which exterior side wall 26 intersects top ripple surface 14 proximate peak 30 and intersects bottom ripple surface 16 proximate valley 32. Any water or wind entering between lots 43–47 can't cross several peaks and valleys so can't enter the structure interior.

In the preferred embodiment, acne half inch radius is used at each peak and valley of the top and bottom ripple surfaces faces 14 and 16 with a seven-eight inch vertical dimension from the tops of the peaks to the bottoms of the valleys and these dimensions are the preferred dimensions in each of the ripple surfaces in the preferred embodiments described herein. In the embodiments illustrated in the drawings, the tops of the peaks and the bottoms of the valleys may be defined as each having an axis parallel to the longitudinal axis of the log in which it is located. However, wooden logs tend to warp even if they are precisely machined and chemically treated. The aforementioned radius on the peaks and the valleys of the ripple surfaces has been deliberately selected to overcome problems created by this warpage.

If any of the logs 43–47 warp their longitudinal axis curves and the peaks and valleys which are to interlock so as to form the log structure 42 are not aligned. If the peaks and valleys were to have sharp edges of the type which would exist if the peaks and valleys were of triangular configuration or rectangular configuration, these sharp edges would be easily dented or broken when trying to place a warped log on a straight log. Such dents or broken pieces would prevent the logs 43–47 being tightly sealed as illustrated in FIG. 3, thus changing alignment of the log structure 42 and requiring caulking to seal any air gaps between the logs 43–47. However, by using the aforementioned radius at the peaks and valleys, the logs are self-aligning and the peaks are sturdy so that when placing a warped log on a straight log it is a simple matter to bend the warped log into position with the peaks and valleys between the logs bringing the logs into self-alignment without breaking or denting the peaks. In assembling the log structure 42 if any of the logs 43–47 are so warped as to not stay in position when brought into alignment with a straight log a few nails or spikes can be driven through the warped log into the straight log to hold them in alignment while the balance of the log structure 42 is erected without using any glue or caulk whatsoever in the construction, which is rapid precut component assembly.

Figure 4:
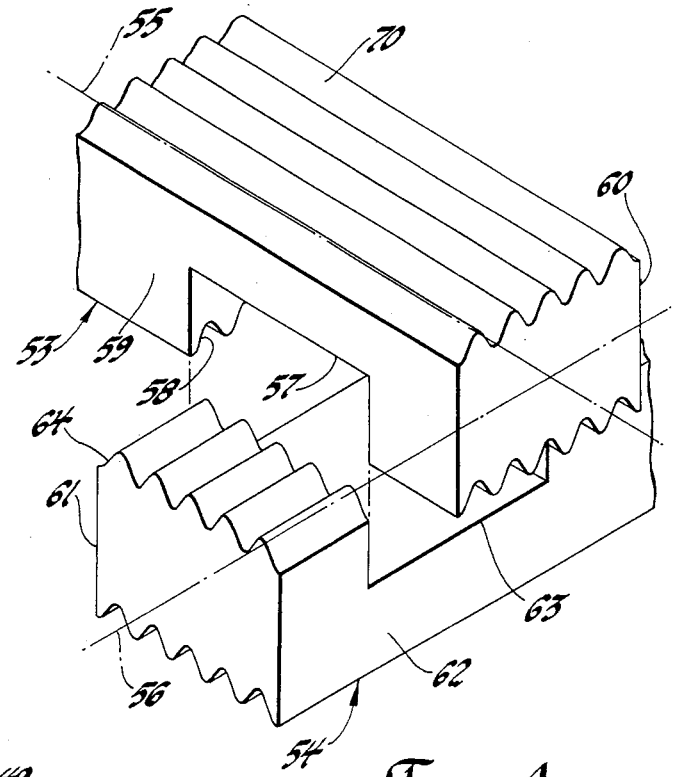
FIG. 4 is a perspective view of the intersection of two logs embodying the principles of this invention.

As shown in FIG. 4, a first log 53 may be joined at a corner of a log structure to a second log 54. This is easiest when their cross-sections are like the log 10 in FIG. 2, though logs having a cross-section like the log 10 in FIG. 1 may be joined in a similar manner using curved blades to notch the logs an using half round logs. Without limiting this invention for purposes of this description logs will be described in which first and second side walls 26 and 28 are flat and parallel as in FIG. 2.

In FIG. 4 the first log 53 is defined by a longitudinal axis 55 and the second log 54 is defined by a longitudinal axis 56 similar to the axis 12 in FIG. 2. A rectangular notch 57 is cut in the bottom ripple surface 58 of the first log 53. The depth of the notch 57 is to the longitudinal axis 55 and its length is from the exterior wall 59 to the interior wall 60. The width of the notch 57 is predetermined to be substantially equal to the distance between the exterior side wall 62 to the interior side wall 61 of the second log 54. In a similar manner a notch 63 is cut in a top ripple surface 64 of the second log 54 to the depth of the longitudinal axis 56. The length of the notch 63 is equal to the distance between the exterior side wall 62 and the interior side wall 61 while the width of the notch 63 is equal to the distance between exterior side wall 59 and interior side wall 60 of the first log 53.

As shown in FIG. 4, the notches 57 and 63 are positioned in the preferred embodiment to interlock so when the first log 53 is put down on the second log 54 as illustrated in FIG. 4 the longitudinal axes 55 and 56 intersect at right angles. Persons versed in the art will appreciate, however, that the first and second logs 53 and 54 could be notched differently to intersect at a predetermined angle other than the preferred angle of a right angle positioning so long as the area of the notches cut in the respective logs 53 and 54 correspond to the area by which the other log is overlapped.

Figure 5:
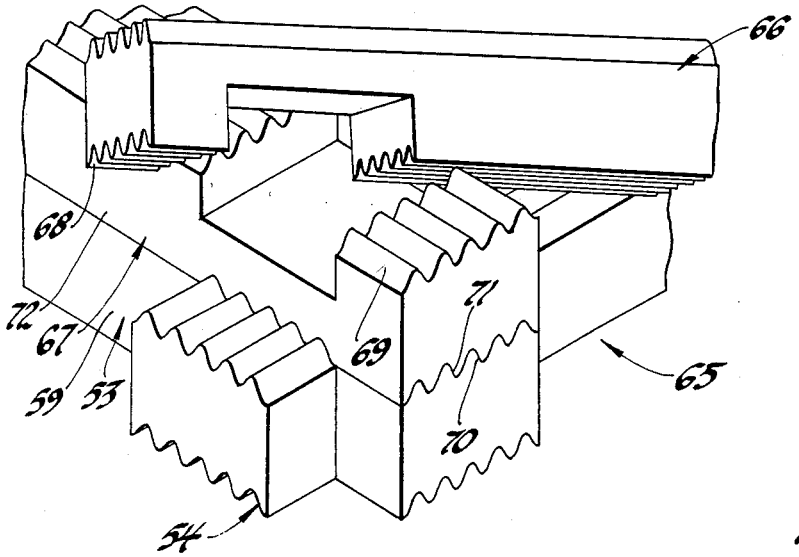
FIG. 5 is a perspective view of four logs embodying the principles of the subject invention at a corner.

As shown in FIG. 5, a log structure 65 is indicated to show the unique interlocking relationship of the logs in the subject invention at a corner. In FIG. 5, a first pair of logs on the bottom is comprised of the first and second logs 53 and 54 described in detail in FIG. 4. The log structure 65 also include third and fourth logs 66 and 67 which comprise a second pair of logs on top of the first pair of logs 53 and 54. The third log 66 is notched through its bottom ripple surface 68 similar to the notch described in the first log 53 while the fourth log 67 is notched in its top ripple surface 69 similar to the notch described previously in the second log 54. Accordingly, when the notches of the third and fourth log 66 and 67 are interlocked, the top ripple surface 64 of the second log 54 interlocks with the bottom ripple surface 68 of the third log 66. Similarly, the top ripple surface 70 of the first log 53 interlocks with the bottom ripple surface 71 of the fourth log 67. The exterior side wall 59 of the first log 53 thus abuts the exterior side wall 72 of the fourth log 67 and are in the same plane. It is similarly apparent that the exterior side walls of the second and third logs 54 and 66 align in a single plane and that the interior side walls of the first and fourth logs 53 and 67 align in a single plane and the same is true of the interior side walls of the second and third logs 54 and 66.

Figure 6:
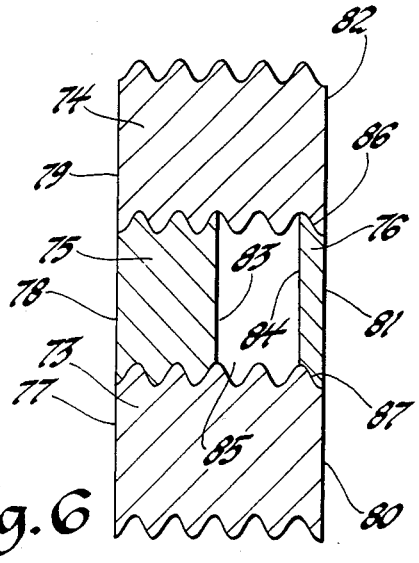
FIG. 6 is a cross-section of a wall which includes four logs embodying the principles of the subject invention which provide an enclosed space within the wall.

Persons versed in the art will appreciate that besides building a solid wall it is necessary to allow for lumbing and wiring in the walls of many log structures. A log structure embodying the principles of the subject invention can easily provide such a space shown in FIG. 6. As shown in FIG. 6, first and second logs 73 and 74 have the same cross-section dimensions. A third log 75 and a fourth log 76 are provided between the first and second logs 73 and 74. All four of the logs 73–76 have ripple top and bottom surfaces that are interlocked as shown in FIG. 6 as described in connection with previous figures. In FIG. 6, the exterior side walls 77–79 all lie in a first plane and interior side walls 80–82 all lie in a second plane. The sum of the thicknesses of the third log 75 from its exterior side wall 78 to its interior side wall 83 added to the thickness of the fourth log 76 from its interior side wall 81 to its exterior side wall 84 is less than the thickness of the first and second logs 73 and 74 from their respective exterior side wall 77 and 79 to their interior side walls 80 and 82. Accordingly, a space 85 exists between the third log 75 and the fourth log 76.

It will be noted in FIG. 6 that the exterior side wall 84 of the fourth log 76 intersects the top ripple surface 86 of the fourth log 76 proximate a peak and intersects the bottom ripple surface 87 of the with log 76 proximate a valley and that the fourth log 76 top and bottom ripple surfaces 86 and 87 each include only a single peak and a single valley. The fourth log 76 may thus be removed from between the first and second logs 73 and 74 without moving any of the other logs in FIG. 6 by pulling the fourth log 76 at right angles to its longitudinal axis an the direction of its interior side wall 81. This permits adding plumbing and wiring in the space 85. When such additions are completed, the fourth log 76 may be replaced between first and second logs 73 and 74 by sliding the peak of its top ripple surface 86 into the first valley of the bottom ripple surface of the second log 74 and then striking the interior side wall 81 to force the valley of bottom ripple surface 87 into alignment with the first peak of the first log 73 top ripple surface. Electrical outlets and plumbing connections to objects in the space 85 can thus be made through the fourth log 76 by cutting suitable holes in log 76.

Figure 7:
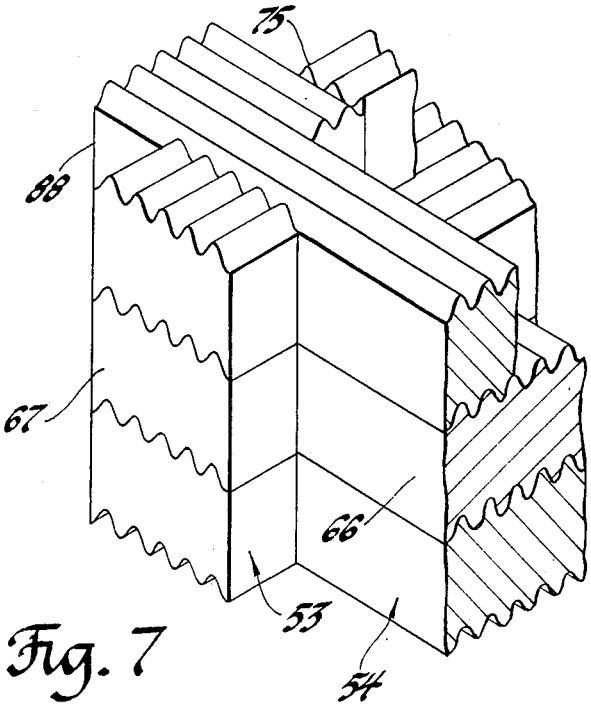
FIG. 7 is a perspective view of a corner intersection of six logs embodying the principles of the subject invention.

FIG. 7 shows the third log 75 and a similar log 88 are notched and interlocked at a corner as previously described and put on the four logs 53, 54, 66 and 67 so their respective ripple surfaces interlock and the exterior surfaces of logs 53, 67 and 75 align in on plane and exterior surfaces of logs 54, 66 and 88 align in another plane. The exterior exposed ends 132 and 133 of logs 75 and 88 have the same width as logs 67 and 66 for a uniform log exterior appearance. It is apparent that if the log 76 and a log similar to it are put on logs 67 and 66 in FIG. 7 as in FIG. 6 all interior log surfaces in each structure wall align in a single plane.

Figure 8:
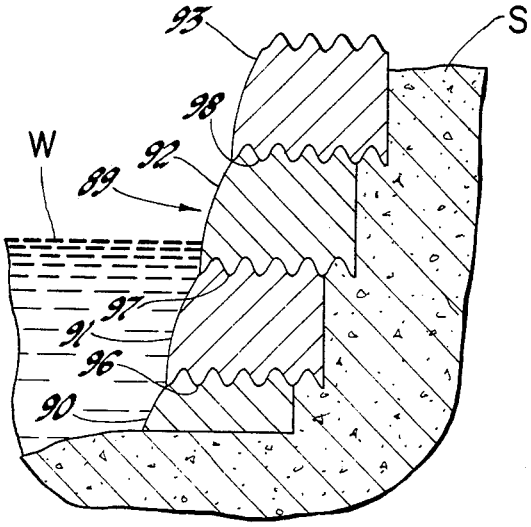
FIG. 8 is a cross-section of a retaining wall comprised of logs embodying the principles of the subject invention.

The logs described in the preceding figures have particular utility in log structures used as part of buildings. As shown in FIG. 8, an ideal retaining wall 89 can also be made from logs 90–93 which embody the spirit of the subject invention. In FIG. 8, the retaining wall 89 is a breakwater used to prevent water W from eroding soil S on the opposite side of the breakwater 89. In the embodiment illustrated in FIG. 8, the top ripple surface of each of the logs 90–93 are beveled so the exterior side wall of each log 90–93 on the side of the water intersects its top ripple surface at a valley aligned with the second peak 96 in the bottom ripple surface of the logs 91–93, so the exterior surfaces of the logs 91–93 are aligned with a valley in the bottom ripple surface of the respective logs 91–93. Persons versed in the art will appreciate that when wood is exposed to moisture it expands. Accordingly, if the logs 90–93 in FIG. 8 are made of wood and a small amount of moisture should happen to enter the location where the logs 90–93 are interlocked at their respective ripple surfaces, the moisture will cause the adjacent wood to expand and provide an even tighter seal so as to prevent additional moisture getting between the logs 90–93. Persons versed in the art will appreciate that the logs 90–93 could be used on dry land as a retaining wall, such as in a flower box rather than in a breakwater where one side frequently is immersed in water.

Figure 9:
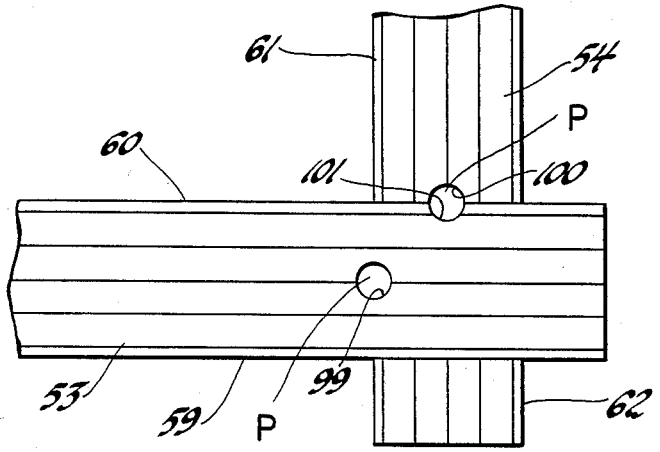
FIG. 9 is a plan view of a corner intersection of two logs embodying the principles of the subject invention.

Persons versed in the art will appreciate that at the corners where logs are notched and intersected as described in FIGS. 4, 5, and 8 the log notches have to be cut slightly larger than the thickness of the logs inserted in the notches so as to permit assembly with a minimum amount of friction resisting the assembly. Accordingly, there may be a small opening at the notches through which air, water and insects may pass. FIG. 9 is a top view of the intersection of first and second logs 53 and 54 described in FIG. 4. As shown in FIG. 9, air may pass from exterior side wall 59 of first log 53 down the interior side wall 61 of second log 54 through the notch 57 previously described. Similarly, air may pass from exterior side wall 62 of second log 54 through the notch 63 along interior side wall 60 of first log 53. This air flow, and any corresponding water or insect passage is prevented by forming a hole 99 in the top ripple surface 70 of first log 53 so it is aligned with interior side wall 61 of second log 54. A corresponding notch (not shown) in interior side wall 61 of second log 54 is made so as to align with the hole 99. Similarly, a hole 100 is formed in second log 54 so as to align with interior side wall 60 at first log 53 and a corresponding notch 101 is made in first log 53 to align with the hole 100. The holes 99 and 100 are then filled with a suitable sealant such as a plastic, polystyrene, silicone or rubber foam or caulk P.

Figure 10:
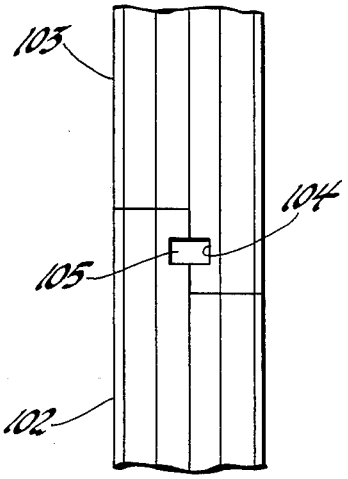
FIG. 10 is a plan view of a butt intersection of two logs embodying the principles of the subject invention.

Persons versed in the art will appreciate that from time to time a log structure may be longer than any available logs. As shown in FIG. 10, two logs 102 and 103 may be butt joined as shown in this plan view with their respective peaks and valleys positioned so the respective axes are in alignment. The logs 102 and 103 are cut by a dado and an appropriate key 105 inserted in the dado cut so as to maintain alignment of the logs 102 and 103 while providing an effective seal to prevent air, water and insects passing through the butt joint.

While the subject invention readily lends itself to logs made of concrete, plastic and other man-made materials, some such logs may be more easily handled in a somewhat different length than conventional wooden logs. Such logs are illustrated in FIGS. 11 and 12.

Figure 11:
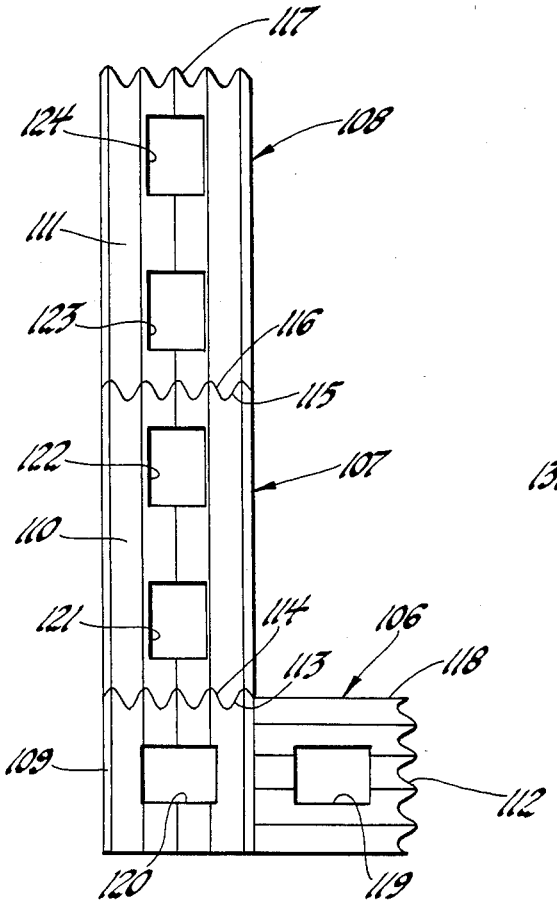
FIG. 11 is a corner plan view of three logs embodying the principles of the subject invention in an alternative embodiment.

As shown in FIG. 11, logs 106–108 are provided with ripple top surfaces 109–111 which each are illustrated as being horizontal in this top plan view. Logs 106–108 also have various vertical ripple surfaces in planes perpendicular to the planes where the ripple top surfaces 109–111 are located.

In FIG. 11, vertical ripple surfaces 112 and 114–117 are formed in the ends of the respective logs 106–108. In addition, vertical ripple surface 113 is a part of side wall 118 of log 106. Persons versed in the art will appreciate that by providing the vertical ripple surface 113 in the side wall 118 of log 106 a corner may be formed between logs 106 and 107. Holes 119–124 are provided in the logs 106–108 for convenient handling and to facilitate the running of wires and plumbing lines.

Figure 12:
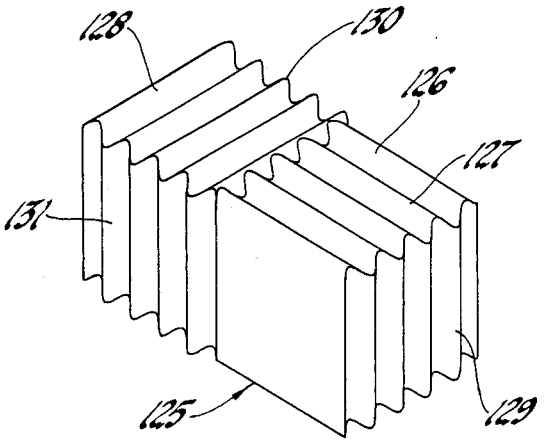
FIG. 12 is a perspective view of a log for use in corners in an alternative embodiment of the subject invention.

As shown in FIG. 12, a log 125 can be provided in a system similar to that shown in FIG. 11 by which an interior log structure can be extended from an exterior log structure. Replacement of the log 106 in the FIG. 11 system by log 125 would accomplish this as log 125 has a ripple top surface 126 in which a first array 127 of peaks and valleys have axes parallel to the longitudinal axis of the log 125 while a second array 128 of peaks and valleys in the ripple top surface 126 have axis at right angles to the axes of the peaks and valleys in the first array 127. Log 125 has a ripple end surface 129 and two ripple side surfaces 130 and 131 in which the peak and valley axes are vertical. The various log 125 ripple surfaces and similar ripple surfaces in half-blocks as conventionally used to overlap joints in each block layer of buildings permit use in many structure configurations.

The log structures of FIGS. 11 and 12 are intended to be made of concrete. Concrete blocks usually are held in place by generous quantities of mortar, but the logs in FIGS. 11 and 12 can be held in place with a thin mastic coating between the logs.

In addition to the various uses described herein, it is apparent that logs which embody the principles of the subject invention can be used in below grade construction, such as in the construction of basements. Persons versed in the art will appreciate that in such environment it may be desirable to spray a waterproof coating on the exterior of the logs with the coating then covered with a styrofoam layer and the exterior of the logs having been pressure treated with chemicals to retard natural rotting.

Persons versed in the art will appreciate from the foregoing description that not only does this invention provide unique log structures but it also provides a unique method of constructing log structures comprising the steps of forming an upper ripple surface in a first log, forming a lower ripple surface in a second log, and stacking the second log on the first log so that the ripple surfaces interlock substantially without spaces between the ripple surfaces. The construction method includes the further steps of forming top and bottom ripple surfaces in four logs, notching the respective top and bottom ripple surfaces of the respective logs, interlocking the logs at the notches, interlocking the logs at the ripple surfaces, forming holes through the logs so as to be aligned with edges of the notches, forming notches that align with the hole, and filling the holes and notches with which they are aligned with a sealant so as to prevent air flow through the notches where the logs interlock.

Throughout this description reference has been made to ripple surfaces comprised of alternating peaks and valleys. Persons versed in the art will appreciate that in implementing the subject invention the top and bottom ripple surfaces have peaks and valleys which are identical in size, spacing and configuration with each other and in fact may be cut using the same knife edge. Persons versed in the art will appreciate that some modification of the ripple surfaces described herein may be made without departing from the spirit of this invention, such as by using a somewhat different radius at the peaks and valleys and a somewhat different overall height or spacing for the ripple surfaces than those described herein. However, a ripple surface by definition has rounded peaks and valleys which are respectively the mirror image of each other.

What is claimed is:

1. A log structure comprising, in combination, first and second logs which are each defined by a predetermined width and a longitudinal axis and which each have top and bottom ripple surfaces which are each substantially defined along planes parallel to said longitudinal axis and side walls on opposite sides of said axis connecting said ripple surfaces, said ripple surfaces each including a series of peaks and valleys of substantially the same size, spacing and configuration, said first log being positioned on top of said second log so their axes are at a right angle to each other, a notch in said first log, said first log notch intersecting said first log bottom ripple surface and being of a length to extend between said first log side walls, a depth substantially to said first log longitudinal axis; a notch in said second log, said second log notch intersecting said second log top ripple surface and being of a length to extend between said second log side walls, a depth substantially to said second log longitudinal axis whereby when said notches are placed together said notches interlock and said axes substantially intersect at substantially said right angle, each of said logs having an interior side wall, said first log containing a hole substantially defined by an axis that is substantially perpendicular to said first log top ripple surface plane and is substantially aligned with said second log interior side wall, said second log containing a hole substantially defined by an axis that is substantially perpendicular to said second log top ripple surface plane and is substantially aligned with said first log interior side wall, said first log having a second notch substantially aligned with said second log hole, said second log having a second notch substantially aligned with said first log hole, and a sealant in each of said holes and second notches so as to provide a seal that prevents air flow past said interior surfaces through said interlocked notches.

2. A log structure comprising, in combination, first, second third and fourth logs which are each defined by a predetermined width and a longitudinal axis and which each have top and bottom ripple surfaces which are substantially defined along planes parallel to said longitudinal axis and side walls on opposite sides of said axis connecting said ripple surfaces, said ripple surfaces each including a series of peaks and valleys of substantially the same size, spacing and configuration, each of said peaks and valleys in each of said logs being defined by an axis that is substantially parallel to said longitudinal axis of said log, said peaks and said valleys in said top ripple surface being substantially aligned with said valleys and said peaks, respectively, in said bottom ripple surface; a notch in said first log bottom ripple surface, said first log notch being of a length to extend between said first log side walls, a depth substantially to said first log longitudinal axis and a width substantially equal to the width of said second log; a notch in said second log top ripple surface, said second log notch being of a length to extend between said second log side walls, a depth substantially to said second log longitudinal axis and a width substantially equal to the width of said first log; a notch in said third log bottom ripple surface, said third log notch being of a length to extend between said third log side walls, a depth substantially to said third log longitudinal axis and a width substantially equal to the width of said fourth log; a notch in said fourth log top ripple surface, said fourth log notch being of a length to extend between said fourth log side walls, a depth substantially to said fourth log longitudinal axis and a width substantially equal to the width of said third log; said first log being positioned on said second log so said first and second log notches interlock and so said first and second log longitudinal axes substantially intersect at right angles; said third log being positioned on said fourth log so said third and fourth log notches interlock and so said third and fourth log longitudinal axes substantially intersect at right angles; said third and fourth logs being positioned on said first and second logs so as to interlock said top ripple surface of said first log with said bottom ripple surface of said fourth log and interlock said top ripple surface of said second log with said bottom ripple surface of said third log; the peaks of the ripple surfaces of said second log extending upwardly to lap the sides of said fourth log.

3. The log structure of claim 2 in which each of said side walls in each said log is substantially defined by a plane substantially perpendicular to said top and bottom ripple surface planes.

4. The log structure of claim 2 in which each of said side walls in each said log is substantially defined by a plane substantially perpendicular to said top and bottom ripple surface planes and intersects said top ripple surface at a valley and intersects said bottom ripple surface at a peak and one of said side walls in each log is an exterior wall, said exterior walls of said first and fourth logs being in substantially the same plane and said exterior walls of said second and third logs being in substantially the same plane.

5. A log structure comprising, in combination, first, second, third and fourth logs that are each defined by a longitudinal axis, each of said logs including top and bottom ripple surfaces that are substantially parallel and each substantially defined along a plane parallel to said axis and two side walls that are each substantially defined by a plane which is substantially perpendicular to said ripple surface planes, the distance between said third log top and bottom ripple surfaces being substantially the same as the distance between said forth log top and bottom ripple surfaces, each of said ripple surfaces in each log including curvilinear uniformly radiused peaks and valleys substantially defined by axes which are substantially parallel to said longitudinal axis of said log, said first log side wall planes being separated a certain distance, said second log side wall planes being spaced said certain distance, the sum of the distances between said third log side wall planes and said fourth log side wall planes being less than said certain distance, said third and fourth logs being positioned between said first and second logs so said longitudinal axes are substantially parallel and said third and fourth log top ripple surfaces interlock said second log bottom ripple surface and said third and fourth log bottom ripple surfaces interlock said first log top ripple surface, said first, second and third logs each having a side wall in a certain plane and said first, second, and fourth logs each having a side wall in a second plane so that a predetermined space exists between said third and fourth logs; said fourth log side wall which is in the same plane as the side wall of said first and second logs intersecting one of said fourth log ripple surfaces at a valley and intersecting the other of said fourth log ripple surface at a peak and said other fourth log side wall intersecting said one of said fourth log ripple surfaces proximate a peak and intersecting said other fourth log ripple surface proximate a valley, said fourth log top and bottom ripple surfaces each including part of a peak and part of a valley whereby said fourth log may be removed from and forcibly inserted between said first and second logs in a direction substantially at right angles to said fourth log axis while said third log ripple surfaces are interlocked with said first and second log ripple surfaces.

6. The log structure of claim 2 in which said peaks and valleys are of uniformly radiused curvature.

7. A method of constructing a log wall comprising the steps of forming top and bottom ripple surfaces in each of first, second, third and fourth logs, having top and bottom surfaces connected by two side surfaces, each of said logs being defined by a longitudinal axis and having a certain width, said ripple surfaces in each log being defined along substantially parallel horizontal planes which are each substantially parallel to said log longitudinal axis and which each contain an array of peaks and valleys which are each defined by an axis parallel to said log longitudinal axis, said log top ripple surface peaks and valleys being aligned with said log bottom ripple surface valleys and peaks, respectively; notching said top ripple surfaces of said second and fourth logs to receive said first and third logs, respectively; notching said first and third log bottom ripple surfaces to receive said second and fourth logs respectively, said log notches each being of a depth to said log longitudinal axis and a length extending between said log side surfaces and a width to receive said respective logs; interlocking said first and second log notches; interlocking said third and fourth log notches; interlocking said first log top ripple surface with said fourth log bottom ripple surface; interlocking said second log top ripple surface with said third log bottom ripple surface; forming holes through said logs perpendicular to said log ripple surfaces, said holes being aligned with an edge of said notches; forming notches in said logs to align with said holes; and filling said holes and notches aligned with said holes with a sealant so as to prevent air flow through said notches where said logs interlock.

8. A log structure comprising, in combination, first and second logs which are each defined by a predetermined width and a longitudinal axis and which each have top and bottom surfaces which are each substantially defined along planes parallel to said longitudinal axis and interior and exterior side walls connecting said surfaces on opposite sides of said axis, said first log being positioned on top of said second log so their axes are at a predetermined angle to each other and each of said logs is overlapped by said other log in an area having certain dimensions, a notch in said first log, said first log notch intersecting said first log bottom surface and being of a length to extend between said first log side walls, a depth substantially to said first log longitudinal axis; a notch in said second log, said second log notch intersecting said second log top surface and being of a length to extend between said second log side walls, a depth substantially to said second log longitudinal axis whereby when said notches are placed together said notches interlock and said axes substantially intersect at substantially said predetermined angle, a hole in said first log, said first log hole being substantially defined by an axis that is substantially perpendicular to said first log top surface plane and is substantially aligned with said second log interior side wall, a hole in said second log, said second log hole being substantially defined by an axis that is substantially perpendicular to said second log top surface plane and is substantially aligned with said first log interior side wall, a second notch in said first log, said first log second notch being substantially aligned with said second log hole, a second notch in said second log, said second log second notch being substantially aligned with said first log hole, and sealing means in each of said holes and second notches so as to provide a seal that prevents air flow past said interior surfaces through said interlocked notches.

* * * * *